US005133112A

United States Patent [19]

Gomez-Acevedo

[11] Patent Number: 5,133,112

[45] Date of Patent: Jul. 28, 1992

[54] CLOSURE DEVICE

[76] Inventor: Hector H. Gomez-Acevedo, Rancho Jigüingo 25 Col., Prado Coapa, 4350, Mexico

[21] Appl. No.: 691,521

[22] Filed: Apr. 25, 1991

[51] Int. Cl.[5] ..... A44B 17/00

[52] U.S. Cl. ..... 24/450; 24/306; 24/449

[58] Field of Search ..... 24/450, 442, 445, 449, 24/452, 306, 453, 297; 2/DIG. 6

[56] References Cited

U.S. PATENT DOCUMENTS

| | | | |
|---|---|---|---|
| 3,319,307 | 5/1967 | Marforid | 24/445 |
| 3,522,637 | 8/1970 | Brumlik | 24/306 |
| 3,686,718 | 8/1972 | Brumlik | 24/306 |
| 3,808,646 | 5/1974 | Brumlik | 24/452 |
| 3,808,648 | 5/1974 | Billarant et al. | 24/442 |
| 3,851,357 | 12/1974 | Ribich et al. | 24/306 |
| 3,899,803 | 8/1975 | Brumlik | 24/306 |
| 3,905,071 | 9/1975 | Brumlik | 24/306 |
| 3,913,183 | 10/1975 | Brumlik | 24/450 |
| 3,981,051 | 9/1976 | Brumlik | 24/447 |
| 4,198,734 | 4/1980 | Brumlik | 24/449 |

FOREIGN PATENT DOCUMENTS

| | | | |
|---|---|---|---|
| 1161406 | 8/1969 | United Kingdom | 24/306 |

*Primary Examiner*—Victor N. Sakran
*Attorney, Agent, or Firm*—Darby & Darby

[57] ABSTRACT

A closure device for joining two surfaces, which is easily engageable and disengageable but provides a firm lock when closed, comprises two substrates, one of the substrates having a plurality of expandable and contractible openings which lie in the plane of the one substrate and the other one of the substrates having a corresponding plurality of fasteners, each comprising a stem attached at one of its ends to the other substrate and extending away from the surface thereof, the free end of the stem having an enlarged locking head having dimensions which are larger than the dimensions of the openings when contracted but sufficiently small to freely pass through the openings when expanded. The stem may also be provided with a plurality of locking projections along its length in order to assist or to replace the locking action of the locking head.

12 Claims, 3 Drawing Sheets

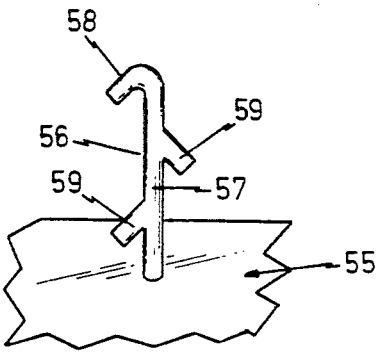
FIG. 8
FIG. 9
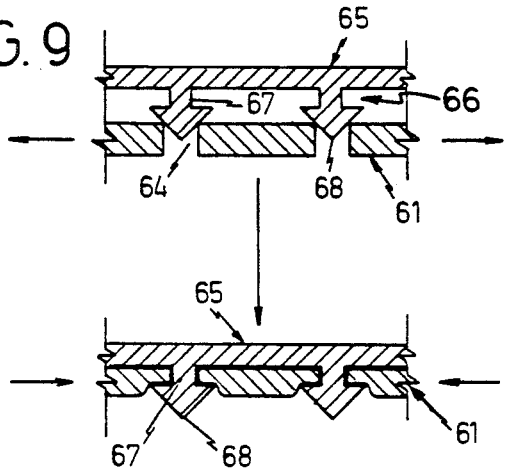
FIG. 10
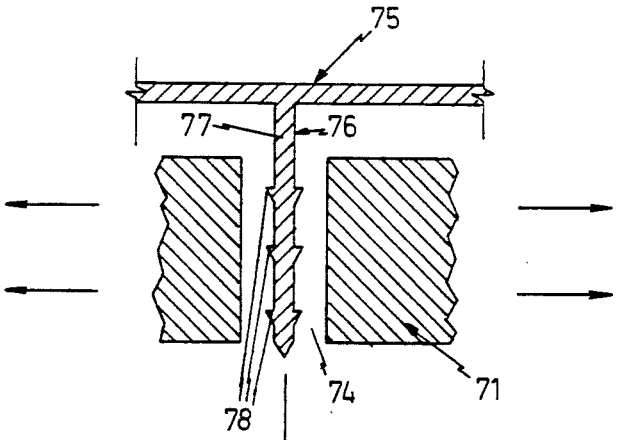
FIG. 11
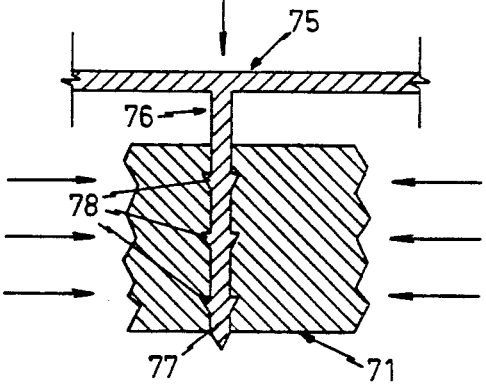
FIG. 12

CLOSURE DEVICE

FIELD OF THE INVENTION

The present invention refers to a closure device for use in joining a pair of surfaces and, more particularly, it is related with a closure device suitable for joining two opposable substrates one of which comprises a plurality of openings and the other one of which comprises a plurality of elongated complementary fasteners.

BACKGROUND OF THE INVENTION

Methods and devices for fastening two or more objects or two or more parts of said objects to each other are very well known in the prior art. The most popular system of this type is constituted by the so called "Velcro System", which essentially comprises a multiplicity of entangled small fibers arranged on the surface of one of the substrates, and a plurality of hooks arranged on the surface of the opposite substrate, which may be in the form of hooked filaments, loops formed with a hard fiber, clips and the like, arranged in a manner such that, when one of the substrates is pressed against the other, the hooks are trapped within the entangled fibers, thus forming a closure device which will necessitate of a predetermined tensile force to be removed from each other and being highly resistant to shearing forces applied to the assembly.

This type of closures, however, are highly degradable after applying such tensile forces repeatedly for a number of times, thus being rendered unsatisfactory after a relatively short use, unless excessively large surfaces are covered with the entangled fibers and the hooks respectively.

Consequently, the workers in the art have for long sought a closure system which, being of the same simple construction as the "Velcro System", may be long lasting and non-degradable by the repeated action of engagement and disengagement thereof. Up to the present date, however, no such system has been found.

OBJECTS OF THE INVENTION

Having in mind the defects of the prior art closure devices. it is an object of the present invention to provide an improved closure device which will be of a simple construction and yet will provide a long lasting resistance to both tensile and shearing stresses.

One other object of the present invention is to provide an improved closure device of the above described character, which will provide for a simple locking and unLocking operations without excessive degradation of the two complementary parts, thus permitting a relatively large number of operations.

A more particular object of the present invention is to provide an improved closure device of the above described nature, which will provide for a more gentle unLocking operation between a male and a female parts thereof, by rendering the female part capable of being stretched sidewardly to open the cavities wherein the hooks of the male part are trapped.

One other object of the present invention is to provide an improved closure device of the above character, which will facilitate manufacture thereof by simple automatic procedures.

The foregoing objects and others ancillary thereto are preferably accomplished as follows:

According to a preferred embodiment of the invention, an improved closure device is provided which essentially comprises a male part and a female part attached to respective substrates to be joined to each other, said male part comprising a flexible plate and a plurality of elongated hooked-type fasteners attached to said plate and preferably perpendicularly extending therefrom to a predetermined distance, each of said elongated fasteners comprising an end embedded in said plate and an opposite or free end comprising a hooked portion, and said female part comprising a plate provided with a plurality of openings normally having a cross sectional size smaller than the length of the hooked portion of said elongated fasteners so as to permit the forced entrance of said hooked fasteners into said openings to be engaged therin with a force sufficient to prevent the disengagement of said parts under a moderate tensile stress applied to both parts, said openings being however sufficiently elastic to permit the disengagement of said parts under a higher predetermined tensile stress applied thereto.

BRIEF SUMMARY OF THE INVENTION

The novel features that are considered characteristic of the present invention are set forth with particularity in the appended claims. The invention itself, however, both as to its organization and its method of operation, together with additional objects and advantages thereof, will best be understood from the following description of specific embodiments when read in connection with the accompanying drawings, in which:

FIG. 8 is a fragmentary perspective view of a closure device built in accordance with a third embodiment of the present invention and showing its male and female parts in the open position.

FIG. 8 is a fragmentary perspective view of a male part of the closure device of the present invention, showing a further embodiment of the elongated fasteners provided on said male part.

FIGS. 9 and 10 are fragmentary cross sectional elevational views of still a further embodiment of the closure device of the present invention, showing said device in its open and closed and locked positions, respectively.

FIGS. 11 and 12 are fragmentary cross sectional elevational views of still one other embodiment of the closure device or the present invention, showing said device in its open and closed and locked positions, respectively.

DETAILED DESCRIPTION

Figure 1:
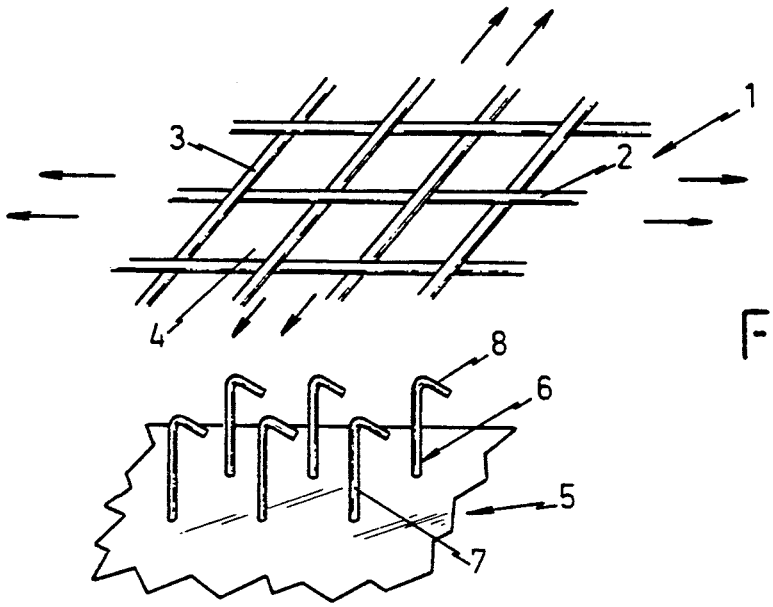
FIG. 1 is a fragmentary perspective view of a closure device built in accordance with a first embodiment of the present invention, and showing its male and female parts spaced apart in the open position, with said female part being stretched in two perpendicular directions.

Having now more particular reference to the accompanying drawings and more particularly to FIG. 1 thereof, there is shown an improved closure device built in accordance with a first embodiment of the present invention, which comprises two independent substrates generally shown at 1 and 5 in in FIG. 1 of the drawings, each one of said substrates being provided with suitable means to be adhered or fastened to the surfaces of two corresponding opposite parts to be joined by the device of the present invention. Substrate 1 is preferably a substrate provided with at least one but preferably a plurality of openings or perforations 4 which, in the particular instance of the embodiment shown in FIG. 1, are formed between a plurality of weft fibers or cords 2 and a perpendicular plurality of warp fibers or cords 3, said openings 4 being capable of expansion or retraction, depending on a force applied in a sideward direction to the warp and weft fibers outwardly of the center of the corresponding substrate 1, the higher said sideward force, the larger will the openings become. Substrate 5, in turn, includes one or more fasteners such as that shown at 6, said fasteners, in the particular instance of the embodiment of FIG. 1, comprising a rigid stem 7 perpendicularly arranged on the surface of substrate 5 and integrally joined at one of its ends to the surface of said substrate 5, with the other or free end 8 of said stem 7 being formed so as to provide a secure fastening end when entangled with the fibers or cords of substrate 1, such as in the shape of a hook (as illustrated in FIG. 1) or as a harpoon head, arrow head, pin head and the like. The substrate 5 may be of an inelastic nature as shown in FIGS. 1 to 3, or it may also be of an elastic nature as illustrated in connection with FIGS. 4 and 5 for a purpose that will be more clearly explained hereinbelow.

When the substrates 1 and 5 are brought together with the hooks confronted with the fibers, said hooks 8 force the fibers 2 and 3 outwardly of the center of the hook and increase the size of openings 4, thus permitting their passage therethrough. When the fastening ends of stems 7 fully pass through the openings 4, the fibers 2 and 3 are released to return to their original position, thus closing the openings 4, whereby the two substrates are firmly fastened. To release the substrates from each other, the fibers or cords 2 and 3 of substrate 1 are manually pulled apart for broadening the openings 4, and the hooks 8 are thusly released to remove substrate 5 from substrate 1.

Figure 2:
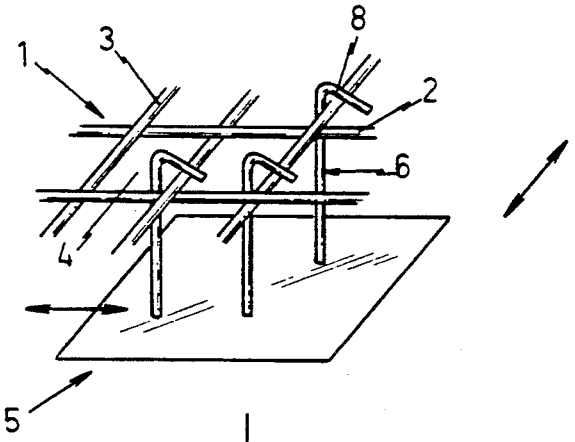
FIG. 2 is a fragmentary perspective view similar to FIG. 1, but showing the closure device in the closed but unlocked position.
Figure 3:
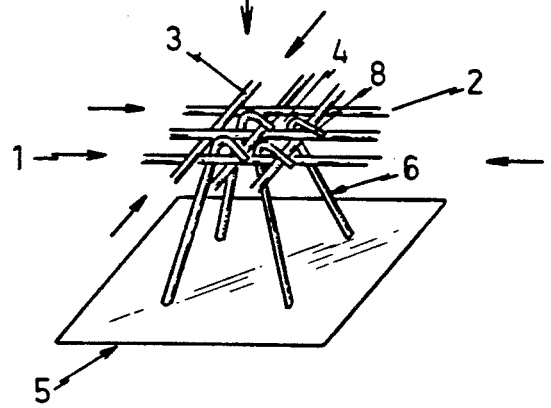
FIG. 3 is a view similar to FIG. 2 but showing the closure device in its closed and locked position, with the female part thereof in the released or non-stretched position.

In FIGS. 2 and 3 of the drawings, there is shown the manner in which the closure device of the present invention accomplishes its function, and particularly FIG. 2 shows the perforate substrate 1 subjected to coplanar tensile forces in two perpendicular senses, with the purpose of increasing the area of the openings or spans 4, for permitting, when the two opposite substrates 1 and 5 approach towards each other, the heads 8 of the fasteners 6 to pass through said openings 4, to thereafter, upon complete passage of the heads 8 through the perforate substrate 1, release the coplanar forces so that said openings 4 decrease in size, thus firmly fastening the heads 8 and avoiding disengagement thereof, as shown in more detail in FIG. 3 of the drawings. In order to remove one substrate from the other, the reverse process is effected, that is, the substrate 1 is subjected to coplanar tensile perpendicular forces, the heads 8 of the fasteners 6 are removed from the openings 4, and the forces applied on the substrate 1 are released upon separation of both substrates as described.

Of course that the forces that will expand the openings 4, may also be pressure forces, for instance, when the heads of the fasteners 6 have a mechanical resistance sufficient to push by themselves on the edges of openings 4, thereby expanding the same when passing therethrough, said openings returning thereafter to their original position when the heads of the fasteners have completely passed through said openings.

Figure 4:
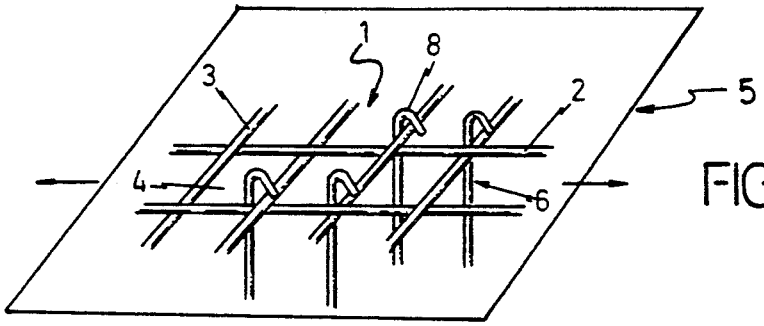
FIG. 4 is a fragmentary perspective view of a closure device built in accordance with a second embodiment of the present invention, showing the female part thereof stretched only in one direction.
Figure 5:
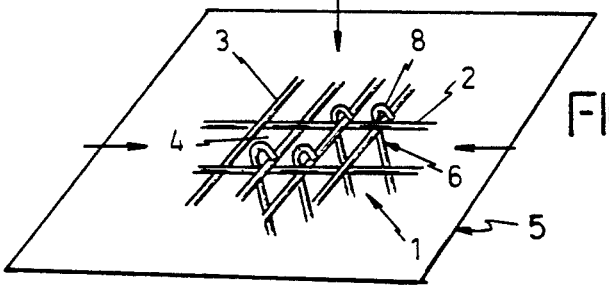
FIG. 5 is a view similar to FIG. 4 but showing the closure device in a closed and locked position, with the female part thereof in the released or non/stretched position.

In FIGS. 4 and 5 of the drawings, there is shown a fastening procedure which is similar to that already described in connection with FIGS. 2 and 3, but with the variation that the openings or spans 4 of the substrate are subjected to tensile forces along one single direction, for instance, in the particular case of this embodiment, the warp fibers 2 are stretched thus spacing apart the fibers of the weft 3, for permitting the insertion of the hooks 8 of fasteners 6 through the openings 4, whereafter the forces applied on the warp fibers 2 are released, to entangle the hooks 8 of the fasteners 6 in the fibers of the weft, which are approached to each other as shown in FIG. 5.

In the particular embodiment of the invention shown in FIGS. 4 and 5, the substrate 5 is shown as an elastic substrate which may at least be stretched in the direction of the arrows shown in FIG. 4, such that, when the fibers 2 are stretched to expand the opening 4, the substrate 5 will also be stretched in order to increase the distance between the fasteners 6 in the same proportion of the expansion of the openings. When the fibers 2 are released, the substrate 5 is also released to contract and maintain the perpendicularity of the fasteners, in the direction of the arrows shown in FIG. 5. It will be obvious to any one skilled in the art that substrate 5 may be stretchable in both perpendicular directions or may be non stretchable as shown in FIG. 3, without departing from the spirit of the present invention.

Figure 6:
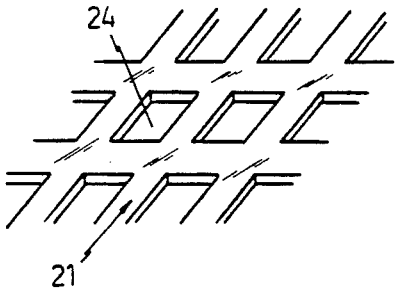

FIG. 6 of the drawings shows another preferred embodiment of the invention, which is a variation in which the perforate substrate indicated by means of reference numeral 21, comprises a plurality of openings 24, said openings having the characteristic that they may be expanded when the heads 28 of the fasteners 26 are introduced therethrough, said heads being, in the instance of this embodiment, in the shape of an arrow head, whereby said heads 28 expand the openings 24 that, after passage of the heads 27 and considering that the material of the substrate 21 is elastic, decrease in size by contraction thereof, thus firmly fastening the heads 28 and preventing disengagement thereof.

In the above described embodiments, when it is desired to remove the substrate 5 or 25 provided with the fasteners, from the perforate substrate 1 or 21 respectively, it is necessary to apply a tensile force on the perforate substrate 1 or 21, in the direction of the highest elastic capacity therof or in the direction of the highest capacity of any one of its properties such as elasticity, compressibility, etc., thus performing as some sort of a safety device which prevents disengagement of the substrate provided with the fasteners after the closure operation, and facilitating, however, the disengagement thereof only when the perforate substrate is subjected to the tensile force mentioned above, whereby when the perforate substrate 1 or 21 is subjected to a tensile force for increasing the area of the openings, only a minimum force applied in a perpendicular direction to the surface of the substrates will be necessary to accomplish separation of said substrates. One other desirable characteristic of the material of which the perforate substrate is made, may be the expansibility thereof, which may also be provided artificially on the material in order to expand or reduce the size of the openings, for instance, by varying its temperature, which may be useful for certain particular applications.

Figure 7:
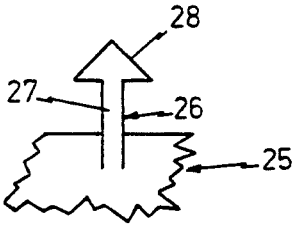
FIG. 7 is a fragmentary perspective view of a closure device built in accordance with a fourth embodiment of the present invention and showing a single composite substrate that is capable of operating both as a male and female part.
Figure 7:
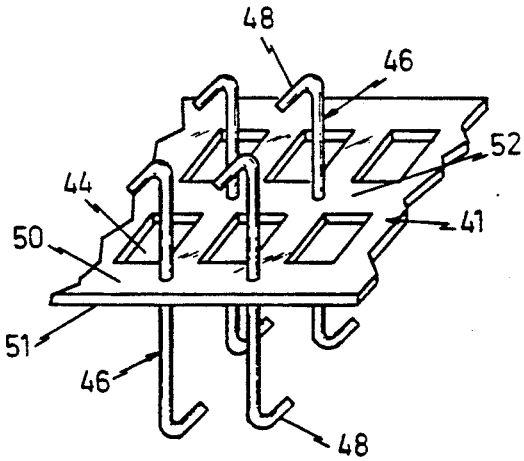

One other embodiment of the invention is shown in FIG. 7 of the drawings, wherein the closure device in accordance with the invention comprises a substrate 41 provided with openings 44 and also provided with perpendicular fasteners 46 with their respective terminal heads 48, said fasteners being arranged both on the upper surface 50 and on the lower surface 51 of the perforate substrate 41, attached to the solid portions 52 surrounding said openings 44.

In this embodiment of the closure built in accordance with the invention, the substrate may be placed over two surfaces or objects which are to be joined, such that it will be supported at the same time on both surfaces or objects, and such that when one of said objects or surfaces is approached to the other, said substrate will be bent over itself, thus joining one portion of said substrate with the remainder thereof. In another application this type of closure device may comprise three perforate substrates, one to be used as an internal substrate and two as external substrates, the internal substrate being built as described and illustrated in FIG. 7 of the drawings, that is, being provided with openings 44 as well as with fasteners 46 on both surfaces thereof, whereas the outer substrates comprise openings 44 as well as fasteners 46 only on one face thereof, preferably on their outer or working surfaces, such that three surfaces or objects may be joined to each other, much in the manner of a sandwiching operation.

FIG. 8 of the drawings shows still another embodiment of the substrate provided with the fasteners, which in this particular instance is designated by means of reference numeral 55, and in which the fasteners 56 comprise a straight stem 57 perpendicular to and joined at its lower end to the substrate 55, and provided along its length with two or more branches or locking projections 59 in the form of harpoon heads, as well as a hook 58 at its free end, for use in combined action with the openings of anyone of the perforate substrates described in connection with the prior figures for forming a closure device.

Having now reference to FIGS. 9 and 10 of the accompanying drawings, there is shown an additional embodiment of the present invention, similar to the embodiment shown in FIG. 6, except for the fact that in this embodiment the length of the stem 27 shown in FIG. 6, is reduced to obtain a short stem in accordance with the present embodiment, such that said stem has the same length as the thickness of the perforate substrate which is thicker in the case of the present embodiment than in the case of the embodiment of FIG. 6, whereby, as the length of the stem of the fastener coincides with the thickness of the substrate provided with the openings, except for the head of the fastener, said head is locked against the inner surface of said substrate provided with openings.

In the embodiment of the invention shown in the above mentioned figures, as it may be clearly seen, the process of fastening is effected by taking advantage of the elastic characteristics of the substrate 65, to which the fasteners 66 are attached, said fasteners 66 consisting of a short straight stem 67 and an arrow head 68, the compressible characteristics of the perforate substrate 61 permitting the entrance of the heads 68 of fasteners 66 through the openings 64, upon expansion thereof due to the triangular form of the arrow heads, and preventing disengagement of the same after said openings return to its original size.

Finally, in FIGS. 11 and 12 of the drawings, showing a further embodiment of the invention, together with the process for fastening the two substrates, the fasteners 76 of the substrate 75 each comprises an elongated stem 77 provided along the length thereof with a plurality of bell shaped projections 78, the widest portion of said projections looking towards substrate 75, and the perforate substrate 71 having a thickness coincident with the length of the stem 77 of the fastener 76, such that the openings 74 are expanded due to the conical shape of the projections 78 provided on said stem, or due to the application of a tensile force along anyone of the directions of substrate 71, to permit the passage of the stem 77 and its projections 78, which will be pressed between the walls of the openings 74 when the tensile forces are released, or when the fastener ceases to push inwardly of the openings, as clearly shown in FIG. 12 of the drawings.

A variety of combinations may be made with the different embodiments of perforate substrate and fastening substrate of the present invention, and it may be seen that for the first time, a closure device having the remarkable properties of being easily closeable and at the same time of remaining securely locked upon closure thereof and yet easily openable by a very simple operation, has been provided, which essentially comprises two or more substrates, at least one of which is provided with expandable openings and at least one other of which is provided with perpendicular elongated fasteners, constituted by a stem having a head at its free end or provided along the length thereof with a plurality of projections similar to the head or different in shape with respect to the head, wherein the free areas of the openings may vary in size either by the pushing force exercised by the heads of the fasteners of the fastening substrate, or when applying a tensile force to the substrate provided with openings, in one or more directions, with the purpose of permitting the introduction of the heads of the fasteners through said openings, which thereafter are contracted when the heads of the fasteners have completely passed through the openings, or when the tensile force ceases to be applied, such that the disengagement of the fasteners from the openings of the substrate will be prevented, thus generating a permanent joint, until the area of said openings is again increased in order to release the fastening devices by the application of a tensile force in one or more directions of the perforate substrate.

On the other hand, the operation of the closure device of the present invention is fast, simple and of practical operation, as it will be evident to anyone skilled in the art, and it must be understood that the illustrative embodiments shown in the accompanying drawings are only of an exemplifying character and do not limit the scope of the invention, inasmuch as the closure device of this invention may be subject to many different variations in the details thereof, for instance, by making the head of the fasteners in a different suitable form, with the only condition that said head must be able to be locked within the openings, and said openings may also have any different suitable shape in order to permit the passage of the fasteners, but not the extraction thereof, except after the application of the above described tensile forces. On the other hand, the material for manufacturing the closure device may be any material having suitable physical characteristics, and may be built by means of a net formed by warp and weft fibers, or may also be built as a solid surface having openings therein, or the stems of the fasteners of the substrate may have a head or said head plus two or more projections along the length thereof, or may be deprived of the head itself and may be only one or more projections along the length of the stem, and the like, all of these variations being intended to fall within the true scope and spirit of the present invention.

Although certain specific embodiments of the present invention have been shown and described above, it is to be understood that many modifications thereof are possible. the present invention, therefore, is not to be restricted except insofar as is necessitated by the prior art and by the spirit of the appended claims.

What is claimed is:

1. A closure device for joining at least two objects to each other, comprising a first substrate attached to one of said objects and a second substrate attached to the other one of said objects, said first substrate being of expandable nature and comprising a plurality of openings arranged throughout its surface, said openings laying in the plane of said first substrate and being capable of enlargement when an expanding force is applied to said first substrate and being capable of returning to their original size when said force ceases, said second substrate including a plurality of fasteners, each comprising a stem extending from the surface of said second substrate, one end of said stem being fixedly attached to the surface of said second substrate, said stem having at its other or free end an enlarged head having dimensions sufficiently small to permit said stems to pass through said openings of the first substrate when a contacting pressure is applied on both said substrates, but sufficiently large to be retained on the other face of said first substrate so as to prevent disengagement of said substrates when such pressure is not applied.

2. A closure device according to claim 1 wherein said first substrate is formed by a plurality of warp fibers and a plurality of weft fibers, said openings being defined by said pluralities of warp and weft fibers, at least one of said pluralities of warp or weft fibers being elastic to permit the expansion and contraction of the openings formed between said fibers.

3. A closure device according to claim 1 wherein said first substrate is a perforate plate having a plurality of openings, said plate being of an elastic material in order to permit expansion and contraction of said openings.

4. A closure device according to claim 1 wherein the fasteners of said second substrate are stems having a head with the shape of a hook.

5. A closure device according to claim 1 wherein the fasteners of said second substrate are stems having a head with the shape of an arrow head.

6. A closure device according to claim 1 wherein the fasteners of said second substrate are stems having a head with the shape of a harpoon head.

7. A closure device according to claim 1 wherein the fasteners of said second substrate are stems having a plurality of sidewardly locking projections or branches distributed along the length of said stem.

8. A closure device according to claim 1 wherein said first substrate has a thickness approximately equal to the length of the stems of said fasteners of said second substrate.

9. A closure device according to claim 1 wherein said second substrate is of an expandable nature.

10. A closure device for joining at least two objects to each other, comprising a first substrate attached to one of said objects and a second substrate attached to the other one of said objects, said first substrate being of expandable nature and comprising a plurality of openings arranged throughout its surface, said openings being capable of enlargement when an expanding force is applied to said first substrate and being capable of returning to their original size when said force ceases, said second substrate including a plurality of fasteners, each comprising a stem extending from the surface of said second substrate, one end of said stem being fixedly attached to the surface of said second substrate, said stem having at its other or free end an enlarged head having dimensions sufficiently small to permit said stems to pass through said openings of the first substrate when a contacting pressure is applied on both said substrates, but sufficiently large to be retained on the other face of said first substrate so as to prevent disengagement of said substrates, and wherein said first substrate is a perforated plate having a plurality of openings, said plate being of an elastic material in order to permit expansion and contraction of said openings, said first substrate being also provided with a plurality of said fasteners perpendicularly arranged and attached to the same in locations other than said openings.

11. A closure device according to claim 10 wherein said fasteners are provided on both faces of said first substrate.

12. A closure device according to claim 11 wherein said second substrate is also provided with a plurality of expandable openings in locations other than those containing said fasteners.

* * * * *